US010259549B2

(12) United States Patent
Lambertus

(10) Patent No.: US 10,259,549 B2
(45) Date of Patent: Apr. 16, 2019

(54) LAUNCH APPARATUS AND VEHICLE

(71) Applicant: ATLAS ELEKTRONIK GMBH, Bremen (DE)

(72) Inventor: Detlef Lambertus, Osterholz-Scharmbeck (DE)

(73) Assignee: ATLAS ELEKTRONIK GMBH, Bremen (DE)

( * ) Notice: Subject to any disclaimer, the term of this patent is extended or adjusted under 35 U.S.C. 154(b) by 14 days.

(21) Appl. No.: 15/502,874

(22) PCT Filed: Jun. 26, 2015

(86) PCT No.: PCT/DE2015/100262
§ 371 (c)(1),
(2) Date: Feb. 9, 2017

(87) PCT Pub. No.: WO2016/023538
PCT Pub. Date: Feb. 18, 2016

(65) Prior Publication Data

US 2017/0233047 A1 Aug. 17, 2017

(30) Foreign Application Priority Data

Aug. 12, 2014 (DE) ..... 10 2014 111 488

(51) Int. Cl.
*F41F 3/10* (2006.01)
*B63G 8/00* (2006.01)
(Continued)

(52) U.S. Cl.
CPC ..... *B63G 8/001* (2013.01); *B63B 27/02* (2013.01); *F41F 3/07* (2013.01); *F41F 3/08* (2013.01);
(Continued)

(58) Field of Classification Search
CPC ..... B63G 2008/002; B63G 2008/004; B63G 2008/005; B63G 2008/007; B63G 5/00; F41F 3/08; F41F 3/10; F41F 3/00
See application file for complete search history.

(56) References Cited

U.S. PATENT DOCUMENTS 3,613,618 A * 10/1971 Gruber ..... F41F 3/08 114/21.1
5,666,900 A 9/1997 Carroll et al.
(Continued)

FOREIGN PATENT DOCUMENTS

DE 39 40 583 A1 6/1991
DE 10 2010 0006 804 A1 8/2011
(Continued)

OTHER PUBLICATIONS

International Search Report for PCT/DE2015/100262 dated Oct. 9, 2015; English translation submitted herewith (8 pages).
(Continued)

*Primary Examiner* — Andrew Polay
(74) *Attorney, Agent, or Firm* — Fitch, Even, Tabin & Flannery LLP

(57) ABSTRACT

The invention relates to a launch apparatus for an Unmanned Underwater Vehicle—in particular, for an Autonomous Underwater Vehicle or for a Remotely Operated Vehicle—with a launching tube having an inner wall and an outlet, and the Unmanned Underwater Vehicle contained within the launching tube, whereby the Unmanned Underwater Vehicle has a vehicle casing with a vehicle casing inhomogeneity, such that an ejection of the Unmanned Underwater Vehicle causes different contact loads between the vehicle casing and the inner wall, whereby the Unmanned Underwater Vehicle has a detachable compensating form, which is designed in such a way that the vehicle inhomogeneity is compensated, such that the result is a combination of the Unmanned Underwater Vehicle and the detachable compensating form, the combination whereof, when ejected, causes a substantially more uniform contact load to occur between the combination and the inner wall.

11 Claims, 2 Drawing Sheets

Figure 1:
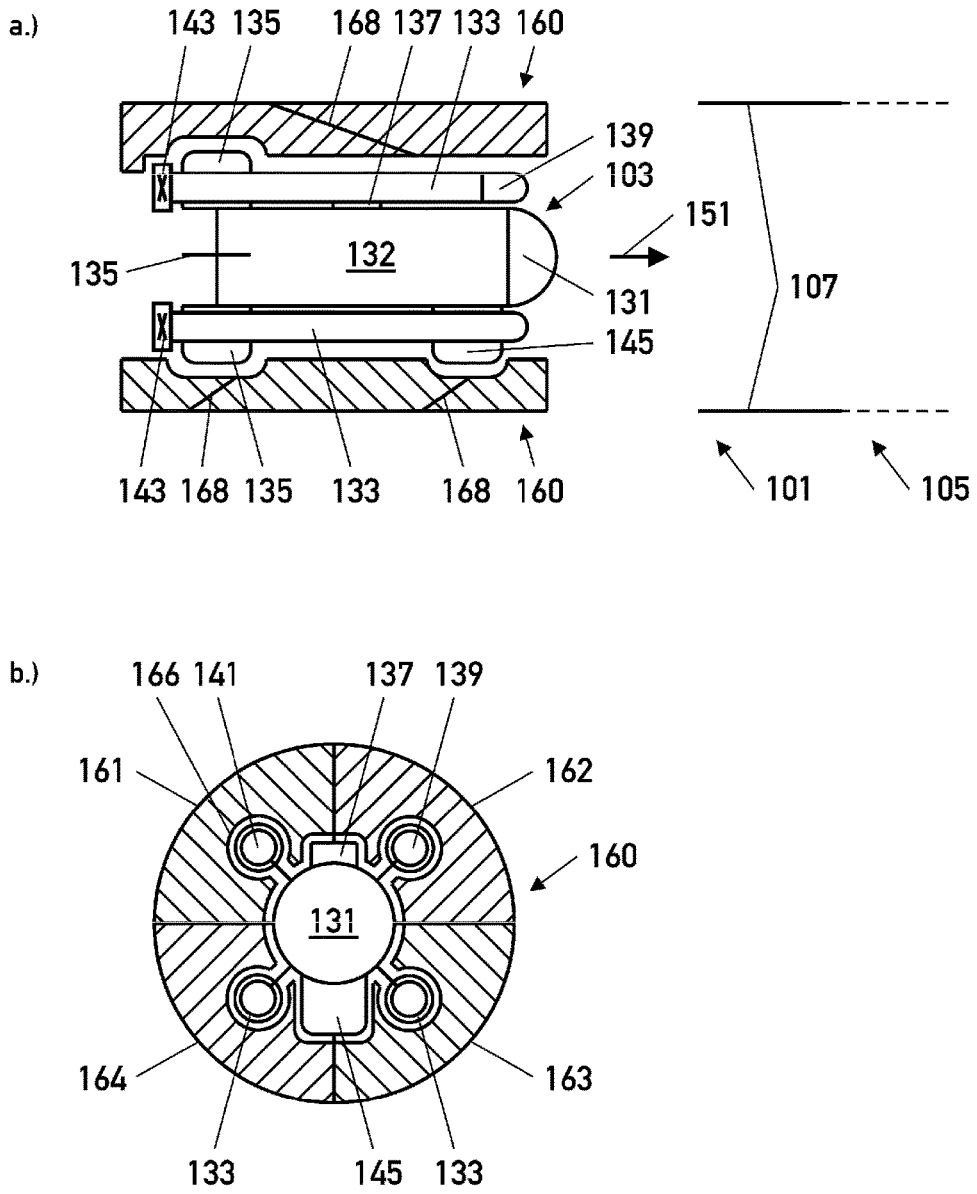

(51) Int. Cl.

| | |
|---|---|
| ***F41F 3/07*** | (2006.01) |
| ***B63B 27/00*** | (2006.01) |
| ***F41F 3/08*** | (2006.01) |
| *B63G 1/00* | (2006.01) |

(52) U.S. Cl.
CPC ..... *F41F 3/10* (2013.01); *B63G 1/00* (2013.01); *B63G 2008/004* (2013.01); *B63G 2008/007* (2013.01); *B63G 2008/008* (2013.01)

(56) References Cited

U.S. PATENT DOCUMENTS

| | | | | |
|---|---|---|---|---|
| 6,484,618 | B1 * | 11/2002 | Dubois | B63G 8/28 114/22 |
| 6,502,528 | B1 * | 1/2003 | MacLeod | F41F 3/10 114/238 |
| 6,577,990 | B1 * | 6/2003 | Kotlow | F41F 3/08 114/20.1 |
| 8,181,906 | B2 * | 5/2012 | Koessler | F41F 1/00 244/63 |
| 2009/0151617 | A1 | 6/2009 | Lambertus | |
| 2015/0008280 | A1 | 1/2015 | Smoker | |

FOREIGN PATENT DOCUMENTS

| | | | |
|---|---|---|---|
| EP | 2810867 | A1 | 12/2014 |
| FR | 2 983 288 | A1 | 5/2013 |
| JP | 2010-190440 | A1 | 9/2010 |

OTHER PUBLICATIONS

International Search Report for PCT/DE2015/100262 dated Oct. 9, 2015; English translation submitted herewith (3 pages).

* cited by examiner

LAUNCH APPARATUS AND VEHICLE

CROSS-REFERENCE TO RELATED APPLICATIONS

This application is a U.S. national phase application filed under 35 U.S.C. § 371 of International Application No. PCT/DE2015/100262, filed Jun. 26, 2015, designating the United States, and claims priority from German Patent Application No. 10 2014 111 488.4, filed Aug. 12, 2014, and the complete disclosures of which applications are hereby incorporated herein by reference in their entirety for all purposes.

FIELD

The invention relates to a launch apparatus for an Unmanned Underwater Vehicle—in particular, for an Autonomous Underwater Vehicle or for a Remotely Operated Vehicle—having a launching tube, which comprises an inner wall and an outlet, and the unmanned underwater vehicle contained therein, wherein the unmanned underwater vehicle features a vehicle casing having vehicle casing inhomogeneity, such that an ejection of the Unmanned Underwater Vehicle causes different contact loads to occur between vehicle casing and inner wall, as well as a vehicle that has the launch apparatus.

BACKGROUND

Unmanned Underwater Vehicles (UUV) such as, for example, a Remotely Operated Vehicle (URV) or an Autonomous Underwater Vehicle (AUV), are usually brought into the water using a crane, in order to subsequently start their respective missions. The infrastructure for such a crane is partly difficult to implement. Particularly in cases where rubber boats are used, such a crane superstructure is either hardly possible at all or requires enormous infrastructural and personal resources.

In addition to that, such UUVs cannot be brought into the water simply by using launching tubes, due to their inhomogeneous shape, which deviates from the cigar-like shape of a torpedo, e.g., radially and/or axially. In some cases, such devices are "thrown" into the water by individuals, which can easily result in damage to the UUV. Moreover, the individuals doing the throwing are exposed to some danger of being injured, as well as to the risk of falling into the water themselves while trying to deploy the vehicle.

SUMMARY

The invention is based upon improving the state of the art.

This objective is met by a launch apparatus for an Unmanned Underwater Vehicle (UUV)—in particular, for an Autonomous Underwater Vehicle (AUV) or for a Remotely Operated Vehicle (ROV)—with a launching tube having an inner wall and an outlet, and the Unmanned Underwater Vehicle contained within the launching tube, whereby the Unmanned Underwater Vehicle has a vehicle casing with vehicle casing inhomogeneity, such that an ejection of the Unmanned Underwater Vehicle causes different contact loads between the vehicle casing and the inner wall, whereby the Unmanned Underwater Vehicle has a detachable compensating form, which is designed in such a way that the vehicle inhomogeneity is compensated for, such that the result is a combination of the Unmanned Underwater Vehicle and the detachable compensating form, which, when ejected, causes a substantially more uniform contact load to occur between the combination and the inner wall.

By using the described detachable compensating form, the inhomogeneous vehicle casing shape can be compensated for in such way as to enable the Unmanned Underwater Vehicle in question to be brought into the water through an existing launching tube.

In addition to that, complicated crane superstructures are no longer necessary. A launching tube with the inserted combination can also be used in conjunction with inflatable boats. Thus, even when strong waves are present or during military operation scenarios under heavy fire, the Unmanned Underwater Vehicle can still be safely sent on its mission.

The main idea behind the present invention relates, in particular, to the fact that Unmanned Underwater Vehicles, which cannot be launched into the water via launching tubes in a safe and damage-free way due to their shape, can be adjusted to the launching tube by adding an additional form, so that the underwater vehicles can be launched into the medium of operation together with the respective compensating form.

The following terms need explanation:

A "launch apparatus" is a system which serves the purpose of launching underwater vehicles. The launching can here mean introducing the vehicles directly into the water medium or also via air into the water.

An "Unmanned Underwater Vehicle" is a vehicle which primarily moves under water and, in particular, is provided with its own drive. Unmanned Underwater Vehicles comprise Remotely Operated Vehicles (ROVs) and Autonomous Underwater Vehicles (AUVs). All these watercraft are essentially subsumed under the term Unmanned Underwater Vehicle (UUV).

The "launching tube" is a tube-like structure via which, in this case, the vehicle is launched into the water. The launching tube has a round, circular basic form, although rectangular, polygonal, or square basic forms are also possible. The column-like form is essential.

Inside the launching tube, an "inner wall" is arranged, which essentially serves the purpose of a guiding surface, so as to enable a defined launching of the underwater vehicle/the combination.

In order to complete the transfer into the target medium (air/water), the launching tube has an "outlet." This outlet can be designed to be controllable and openable or can also be formed as a simple opening.

The "vehicle casing" of the Unmanned Underwater Vehicle essentially corresponds to the casing that envelops the watercraft. This specifically comprises the enveloping casing, which is "radially extended outward" and is in touching contact with the inner wall of the launching tube.

"Vehicle casing inhomogeneity" comprises all components and bulges which deviate from an even form, e.g., a cigar-like form, radially or axially. For example, an Unmanned Underwater Vehicle is equipped with camera lamps, tool holders, sonars, or GPS devices, which are arranged at different positions on the underwater vehicle and which make it difficult for the underwater vehicle to have an even profile over the entire length of the vehicle, or prevent it altogether. Such vehicle inhomogeneity might result, for example, when the underwater vehicle is brought into the launching tube, in the underwater vehicle tipping over and ending up resting only on two points, or a defined positioning not being possible. In addition to that, an ejection of the underwater vehicle from the launching tube would in particular lead to certain components of the underwater vehicle coming into grinding contact with the launching tube, which could result in damage to the launching tube or to the grinding component of the underwater vehicle. Some components could even be caught or torn away in the process. All of the described contact effects are presently subsumed under "different contact loads."

The "detachable compensating form" complements the underwater vehicle such that, via the detachable compensating form, the underwater vehicle forms a contact with the inner wall of the launching tube. Ideally, the detachable compensating form has such a large outer surface, which comes into touching contact with the inner wall of the launching tube, that a method of "combining" the Unmanned Underwater Vehicle with the compensating form leads to a defined movement during the ejection of the combination. In particular, the detachable compensating form can extend over the entire length of the Unmanned Underwater Vehicle, and even further than that. Also, several different compensating forms can be provided, which envelop the Unmanned Underwater Vehicle at particular distances respectively.

An essentially even "contact load" is provided, in particular, if the inner wall comes into contact with an outer surface of the detachable compensating form. Specifically, the surface that comes into contact with the inner wall is larger than the contact surface, which would occur if the Unmanned Underwater Vehicle were to contact the inner wall of the launching tube without the detachable compensating form.

"Detachable" means that there is only slight contact between the Unmanned Underwater Vehicle and the compensating form; such contact is lost at the moment when the combination is immersed into the medium of immersion (air or water). The detachability can in particular relate to the fact that only mechanical contact is maintained, and is lost when leaving the launching tube. An adhesive can also be used. In a simple embodiment, the adhesive can be a painter's tape, which, when exposed to exertion of small effort without the stabilizing effect of the inner wall of the launching tube, will detach the combination, so that, after immersion, the compensating form is separated from the underwater vehicle. This separation can occur, for example, because of pressure differences, or due to the spring effect or to the fact that water is a chemical solvent.

In one embodiment, the launch apparatus is provided with a relay facility, which is connected to the underwater vehicle and/or the compensating form by way of a data exchange line—in particular, by way of a fiber optic cable—whereby the relay facility is arranged on the inside of the launch tube and is moved into a discharge medium after the ejection of the combination.

Via such relay facilities, communication with the Unmanned Underwater Vehicle can be achieved in a beneficial manner. In particular, such a relay facility can be equipped with a fiber optic line led in a cross winding and connected with the underwater vehicle, whereby the underwater vehicle in particular is also equipped with a cross winding coil. Thereby, the connecting fiber optic line can, for example, be thinner than a fiber optic cable, which is connected to the launching system (for example, a ship). For example, in the event of the underwater vehicle being utilized for mine hunting, the relay facility can, for example, be a layer, which will maintain a certain distance from the found mine due to its vertically-oriented weight force, and thus its location-related stability. Due to the fact that the relay facility is arranged inside the launching tube, it can be brought into the target medium simultaneously with the Unmanned Underwater Vehicle.

In one such specific embodiment, the relay facility has a relay casing with a relay casing inhomogeneity, so that ejection of the relay facility causes different contact loads between the vehicle casing and the inner wall, whereby the relay facility has a relay facility compensating form, which is designed in such a way that the relay casing inhomogeneity is compensated for, so that the result is a combination of the relay facility and the relay facility compensating form, which, when ejected, causes a substantially even contact load to occur between the relay combination and the inner wall.

Presently, the idea of the invention is also based upon the fact that the relay facility is respectively adjusted to the launching tube. The definitions correspond to the definitions above, whereby the definitions present relate to the respective relay facility instead of to the underwater vehicle. It should be noted here that relay casing inhomogeneity is already present when the inner wall of the launching tube envelops the relay facility in a contacting manner.

Preferably, the relay facility can be ejected in a delayed manner after the ejection of the underwater vehicle, in order to ensure that the relay facility is not destroyed by the ejected underwater vehicle. This can be achieved, for example, by providing for the relay combination to exert a higher resistance against the inner wall of the launching tube than the resistance exerted by the combination.

In a further embodiment, the detachable compensating form(s) and/or the relay casing compensating form(s) comprise two, three, four, five, or more individual forms, which, in particular, together form the compensating form and/or the relay casing compensating form.

By using this "jigsaw puzzle" approach in forming the compensating form or the relay casing compensating form, separating the combination or the relay combination can be made significantly easier. The individual forms can be provided, in particular, in radial direction, or also in longitudinal direction. In the event of the relay casing compensating form or the compensating form being formed by individual forms with longitudinal orientation, angled separating areas are beneficial, since they facilitate the slipping away of the individual forms, and thus the entire separation of the combination or the relay combination.

In order to facilitate the separation of the combination or of the relay combination, the combination and/or the relay combination can have a spring element and/or a tension element, which separate the combination and/or the relay combination after leaving the launching tube, so that the underwater vehicle and/or the relay facility is/are ready for use.

For example, such a spring element can be provided by arranging tensioned spring elements in the Unmanned Underwater Vehicle, which press the compensating form or the relay casing compensating form against the inner wall of the launching tube. As soon as the combination or the relay combination leave the launching tube, the back pressure from the inner wall of the launching tube no longer exists, so that the compensating form or the relay casing compensating form are removed by the spring elements.

An inverse solution or a combination with the first solution can also be realized, in that additionally or alternatively, the compensating form and/or the relay casing compensating form is/are provided with spring elements (e.g., spiral springs), which exert spring tension on the casing of the underwater vehicle or the relay facility.

A tightened (metal) tape can also be provided, for example, which is placed around the compensating form and/or the relay casing compensating form. Here, this tape is also arranged in such a way that the inner wall of the launching tube counteracts the spring tension of the tape or metal tape.

In an embodiment of this type, the detachable compensating form and/or the relay casing compensating form realize the spring element. This can be achieved, for example, by the choice of material for the compensating form or the relay casing compensating form. Thus, for example, plastic materials can be used, which are compressible in a partly reversible manner. In this case, for example, the relay casing compensating form and/or the compensating form can be designed to have a conical shape, so that the compensating form or the relay casing compensating form can be easily inserted into the launching tube, and, as the insertion into the tube progresses, the compensating form is exposed to increasing pressure from the inner wall of the launching tube, which results in compression of the compensating form or the relay casing compensating form. As soon as the combination or the relay combination leaves the launching tube, this pressure is relieved, and the compensating form or the relay casing compensating form separates.

In order for the separation to occur in a particularly effective manner, the detachable compensating form and/or the relay casing compensating form can have a resistance area and/or a predetermined breaking point, which, due to an outlet speed of the combination and/or the relay combination, is/are exposed to a force from the outlet medium, so that the combination and/or the relay combination is/are separated. The resistance area can hereby be formed, for example, by the edge of the relay casing compensating form or the compensating form. It is of substantial importance here that the pressure exerted on the compensating form and/or the relay casing compensating form at ejection results in a separation.

In order to keep the combination dry inside the launch apparatus prior to its use, the launching tube can be equipped with an outlet closure that can be opened in a controllable manner.

Thus, the outlet closure will only be opened in a real operation scenario. This can be done electronically, for example, or also by the actual ejection process of the combination and/or the relay combination.

In a further embodiment, the launch apparatus is equipped with acceleration means, which, in activated state, exert a force on the combination and/or the relay combination in the direction of the outlet, so that, when the outlet is open, the combination and/or the relay combination is brought into the outlet medium.

The ejection can also be achieved by, for example, tilting the launching tube about 40° against the horizontal line, so that the combination is brought into the outlet medium through the gravitational force; however, inside the tube, a positive pressure can also be generated, e. g., by an explosion or by compressed air, which pressure realizes a "blowing out" of the combination and/or the relay combination.

The outlet medium can, in this case, be water as well as air.

In a further aspect, the aim is achieved by a vehicle—in particular, a ship, boat, submarine, helicopter or plane, or a transport device—whereby the vehicle or the transport device is equipped with a launch apparatus described above.

This can enable completely new scenarios for quick-deployment operations to be executed. For example, a helicopter can be equipped with a launching tube that is arranged vertically. When the controllable outlet closure is opened, the gravitational force causes the combination to leave the launching tube. In the air, the air resistance causes the compensating form to be dragged away, and the underwater vehicle can plunge into the water. In particular, here, the relay facility can be a buoy, which is connected to the UUV via a glass fiber line and can communicate with the helicopter or the operations center via radio.

By means of the transport device, port monitoring can be completed very quickly. In this case, the transport facility can be a container or a similar object, for example, in which the launch apparatus is arranged. If, for example, divers or other suspicious activity are detected in a port area, the Autonomous Underwater Vehicle can be used for reconnaissance. Thus, presently, only the launch apparatus described above has to be provided, and it can be adapted to different operation scenarios and means of transport. This provides a very quick and infrastructure-independent immersion method for Unmanned Underwater Vehicles.

BRIEF DESCRIPTIONS OF THE DRAWINGS

Figure 2:
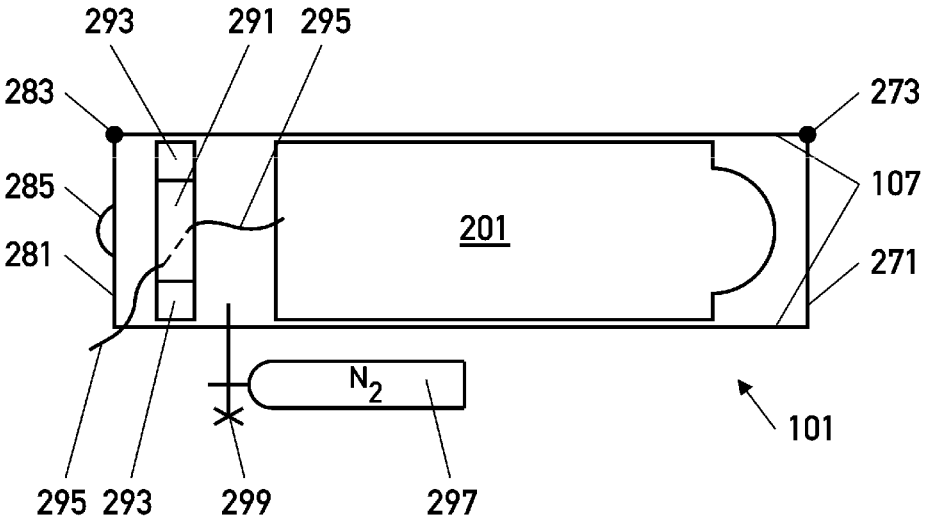

The invention is further explained using an exemplary embodiment. The figures show the following:

FIG. 1*a* a schematic representation of a combination of an ROV with a corresponding compensating form and an assigned launching tube in a side view, FIG. 1*b* a very schematic representation of the combination of FIG. 1*a* in a front view, and FIG. 2 a combination and corresponding relay combination that are positioned in a launching tube.

DETAILED DESCRIPTION

Launch apparatus 101 has ROV 103 and launching tube 105. Launching tube 105 has inner wall 107 as well as opening flap 271, which can be opened via opening joint 273, and insertion flap 281, which can be opened via insertion joint 283 and by using handle 285 for opening.

ROV 103 has ROV body 132, which has tool head 131, arranged at the top of it, and fins 135 arranged at the back. On its top side, ROV 103 has additional GPS-receiver 137, and, on its bottom side, active sonar 145. For power supply, four battery containers 133 are arranged on the side. On one of battery containers 133, camera 139 is arranged in the front area. In addition to that, on one of battery containers 133, lamp 141 is arranged in the front area.

On the outside of ROV 103, ROV-contour 166 is formed. The distance between the actual components and the contour designated with reference number 166 that is shown in FIG. 1*b* only serves illustration purposes. In reality, compensating form 160 touches the individual points directly, and the transition between compensating form 160 and ROV 103 forms actual contour 166.

Compensating form 160 is formed by four radial compensating form quarters 161, 162, 163, 164. These quarters have a pressure surface (hatched in FIG. 1*b*). As soon as combination 201 of compensating form 160 and ROV 103 is immersed in water, pressure is exerted upon the contact surface (hatched area in FIG. 1*b*).

Moreover, compensating form 160 has longitudinally arranged contact slants 168, which cause the parts of compensating form 160 to slide apart after ejection. Compensating form 160 is made from an elastic plastic material.

The circumference of combination 201 is approx. 1 mm wider than the caliber of launching tube 105. In case of operation, combination 201 is inserted into launching tube 105 by pushing in insertion direction 151 and slight pressing into launching tube 105. Between compensating form 160 and inner wall 107 of launching tube 105, a pressure is exerted upon combination 201, which pressure closes combination 201 and launching tube 105.

In the area at the back of launching tube 105, layer 291 is provided, which serves as a relay station after immersion. Inside layer 291 and in the back of ROV 103, coils with cross-wound glass fiber lines are arranged, which unwind during the departure of ROV 103, due to the departure speed and the force exerted thereby.

In addition to that, layer 291 is equipped with an additional glass fiber line that can enable communication between the ROV and, for example, a ship. Enveloping layer 291, layer compensating form 293 is arranged, which adjusts layer 291 to the caliber of launching tube 105. In the back area of launching tube 105, an access for compressed air cylinder 297 is provided, which can be filled with compressed air via valve 299.

In case of operation, opening flap 271 is closed. First, combination 201 is inserted in launching tube 105. After that, layer 291 along with layer compensating form 293 is also inserted into launching tube 105.

Finally, previously opened insertion flap 181 is closed manually via insertion joint 283 using handle 285. In operation, opening flap 271 is completely opened electronically via opening joint 273. Via the resulting outlet, a transition into the outlet medium (water) is provided. Immediately after activation of the ROV via glass fiber cable 295, valve 299 is abruptly opened, so that the compressed air in compressed air cylinder 297 expands into the back area of launching tube 105, causing first combination 201 and, subsequently, layer 291 along with layer compensating form 293 to exit the launching tube.

As soon as the combination is in the water and no longer exposed to pressure from inner wall 107 of launching tube 105, compensating form 160 separates from the ROV, and layer compensating form 293 from layer 291. Due to the weight force, layer 291 is pulled vertically down shortly after the outlet. The activated ROV, which is now freed from compensating form 160, can then perform its mission.

LIST OF REFERENCE NUMBERS

101 Launch apparatus
103 ROV
105 Launching tube
107 Inner wall of launching tube
131 Tool head
132 ROV body
133 Battery container
135 Fins
137 GPS
139 Camera
141 Lamp
143 Drive
145 Sonar
151 Insertion direction
160 Compensating form
161 first radial compensating form quarter
162 second radial compensating form quarter
163 third radial compensating form quarter
164 fourth radial compensating form quarter
166 Contour
168 Contact slants
201 Combination
271 Opening flap
273 Opening joint
281 Insertion flap
283 Insertion joint
285 Handle
291 Layer
293 Layer compensating form
295 Glass fiber cable
297 Compressed air cylinder
299 Valve

The invention claimed is:

1. A launch apparatus for an unmanned underwater vehicle, said launch apparatus comprising a launching tube having an inner wall and an outlet, the unmanned underwater vehicle contained within the launching tube, the unmanned underwater vehicle having a vehicle casing, the vehicle casing having inhomogeneity, the unmanned underwater vehicle having a detachable compensating form configured to compensate for the vehicle casing having inhomogeneity so that when a combination comprised of the unmanned underwater vehicle having the detachable compensating form is ejected from the launch tube, a substantially more uniform contact load between the combination and the inner wall occurs in comparison to the different contact load that would occur when the unmanned underwater vehicle without the detachable form is ejected from the launch tube, a relay facility arranged on the inside of the launch tube, the relay facility in the launch tube is associated with but separated from the unmanned underwater vehicle, the relay facility movable to an outlet medium after the combination of the unmanned underwater vehicle and the compensating form are ejected from the launch tube, the relay facility connected with the unmanned underwater vehicle and/or the compensating form by way of a data exchange line, and the relay facility having a relay casing, the relay casing having inhomogeneity so that an ejection of the relay facility without compensating for such inhomogeneity would cause different contact loads between the vehicle casing and the inner wall, the relay facility having a relay facility compensating form configured to compensate for the relay casing inhomogeneity so that a substantially more even contact load occurs between a relay combination comprised of the relay facility and the relay facility compensating form and the inner wall when the relay combination is ejected.

2. The launch apparatus according to claim 1, wherein the detachable compensating form and/or the relay facility compensating form is comprised of a plurality individual forms, which together form the respective compensating form and/or the relay casing compensating form.

3. The launch apparatus according claim 1, wherein the combination and/or the relay combination has a spring element and/or a tension element, which separate the combination and/or the relay combination after leaving the launching tube free from at least one of either the underwater vehicle or the relay facility.

4. The launch apparatus according to claim 1, wherein the detachable compensating form and/or the relay facility compensating form further comprises a spring element.

5. The launch apparatus according to claim 1, wherein at least one of either the detachable compensating form or the relay facility compensating form has a resistance area and/or a predetermined breaking point so that the at least one of the detachable combination and the relay combination become separated, after launch, due to an outlet speed when exposed to a force from an outlet medium.

6. The launch apparatus according to claim 1, wherein the launch apparatus further comprises a controllably openable outlet closure for the launch tube.

7. The launch apparatuus according to claim 3, wherein the launch apparatus further comprises acceleration means, which, in an activated state, exerts a force on the combination and/or the relay combination in the direction of the outlet, so that, when the outlet is open, the combination and/or the relay combination is brought into an outlet medium.

8. A vehicle, including a ship, boat, submarine, helicopter or plane, or a transport facility, wherein the vehicle or the transport facility is equipped with a launch apparatus according to claim 1.

9. The launch apparatus according to claim 1, wherein the unmanned underwater vehicle comprises an autonomous underwater vehicle or a remotely operated vehicle.

10. The launch apparatus according to claim 1, wherein the relay facility is connected to at least one of the unmanned underwater vehicle or the compensating form by fiber optic cable.

11. The launch apparatus according to claim 1, wherein at least one of the detachable compensating form and the relay casing compensating form is comprised of a plurality individual forms, which together form the respective compensating form and the relay casing compensating form.

* * * * *